US007380766B2

(12) United States Patent
Thompson

(10) Patent No.: US 7,380,766 B2
(45) Date of Patent: Jun. 3, 2008

(54) ARTIST'S EASEL

(76) Inventor: Kathryn Thompson, 6615 NE. 22nd Ave., Portland, OR (US) 97211

( * ) Notice: Subject to any disclaimer, the term of this patent is extended or adjusted under 35 U.S.C. 154(b) by 0 days.

(21) Appl. No.: 10/647,690

(22) Filed: Aug. 25, 2003

(65) Prior Publication Data

US 2005/0045795 A1 Mar. 3, 2005

(51) Int. Cl.
*A47B 97/04* (2006.01)

(52) U.S. Cl. ..... 248/449; 248/448; 248/295.11; 248/125.1; 248/297.51; 312/231; 108/144.11; 254/390

(58) Field of Classification Search ..... 254/390, 254/393, 394, 397; 248/125.2, 448, 449, 248/455, 457, 462, 454, 295.11, 297.21, 441.1; 312/231, 233; 108/144.11, 106
See application file for complete search history.

(56) References Cited

U.S. PATENT DOCUMENTS 298,625 A * 5/1884 Saunders ..... 248/647
679,529 A * 7/1901 Hitchcock ..... 248/441.1
1,699,544 A * 1/1929 Rohlfing ..... 182/14
2,670,168 A * 2/1954 Magnan et al. ..... 248/297.21
3,006,107 A * 10/1961 Tolegian ..... 248/449
3,095,666 A * 7/1963 Killen ..... 248/449
3,114,215 A * 12/1963 Turkin ..... 248/449
4,134,614 A * 1/1979 Fielding, Sr. ..... 297/156
4,329,928 A * 5/1982 Shaw ..... 108/106
4,482,185 A * 11/1984 Zoellner ..... 297/135
4,610,414 A * 9/1986 Schuck ..... 248/449
4,726,555 A * 2/1988 Andrews ..... 248/451
4,824,064 A * 4/1989 Oncale ..... 248/441.1
4,856,749 A * 8/1989 Habermann ..... 248/448
5,004,204 A 4/1991 Cook
5,074,513 A 12/1991 Presley et al.
5,188,323 A * 2/1993 David ..... 248/158
5,316,260 A * 5/1994 Johnston ..... 248/648
5,725,192 A * 3/1998 Cloninger ..... 248/458
6,041,739 A * 3/2000 Caradant ..... 119/247

* cited by examiner

*Primary Examiner*—Kimberly T. Wood
(74) *Attorney, Agent, or Firm*—Ingrid McTaggart

(57) ABSTRACT

One embodiment of an easel for supporting an artist work piece includes a vertical support member including an interior, a pulley system positioned completely within the interior, the pulley system adapted for moving a horizontal support member on the vertical support member, and a horizontal support member secured to the pulley system and extending into the interior of the vertical support member.

12 Claims, 9 Drawing Sheets

ARTIST'S EASEL

BACKGROUND

Artist's easels are generally used to support an artist's work piece, such as a pad of paper, a canvas stretched on a frame, a wooden board, or any other such somewhat two dimensional work piece. Supporting the work piece on an easel generally allows the artist to position the work piece at acceptable vertical and horizontal positions so that the artist may easily work on the work piece, such as by painting, drawing, carving or the like.

Many prior art easels comprise a tripod design including three support legs, each leg extending outwardly from a common attachment point at the peak of the legs. The legs of these tripod designs may become a tripping hazard for an artist and generally require a relatively large amount of space behind the work piece. Moreover, these tripod designs generally do not allow the position of the work piece to be easily adjusted during work on the work piece.

Easels including pulley systems have been utilized to adjustably position a work piece. In U.S. Pat. No. 4,726,555 to Andrews, a pulley system easel is disclosed wherein the work piece may be horizontally and vertically adjusted. However, the easel pulley system disclosed is quite large compared to the size of the work piece that may be adjustably positioned on the easel. In particular, the pulley system is positioned externally behind and above the work piece support area such that the easel is approximately twice as high as the work piece that may be supported on the easel. Accordingly, this easel may be difficult to utilize in studio spaces having a relatively short ceiling height. Moreover, the Andrews easel includes a relatively large floor base such that the easel may be difficult to utilize in studio spaces having a relatively small floor area.

Therefore, for these and other reasons there is a need for the present invention.

SUMMARY

One embodiment of an easel for supporting an artist work piece includes a vertical support member including an interior, a pulley system positioned completely within the interior, the pulley system adapted for moving a horizontal support member on the vertical support member, and a horizontal support member secured to the pulley system and extending into the interior of the vertical support member.

DETAILED DESCRIPTION OF THE DRAWINGS

Figure 1:
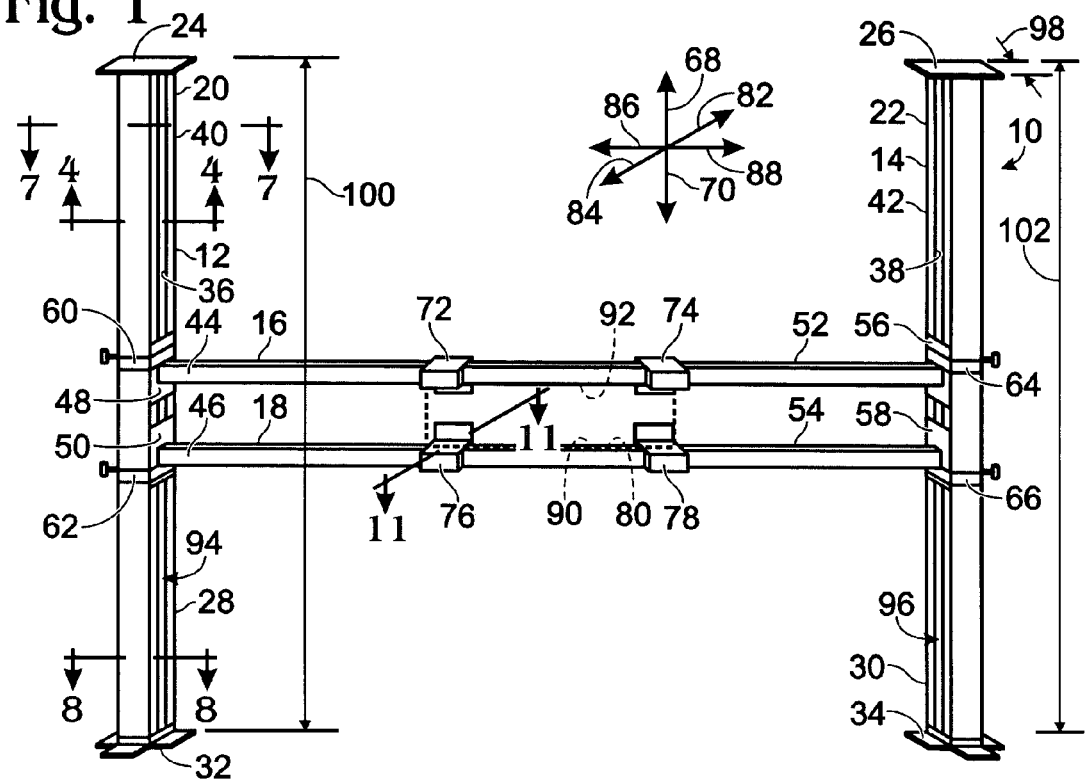
FIG. 1 is a front perspective view of one form of an artist's easel showing the horizontal support bars positioned for supporting a relatively small work piece.

FIG. 1 is a front perspective view of one form of an artist's easel showing the horizontal support bars positioned for supporting a relatively small work piece. Easel 10, in the embodiment shown, comprises two vertical support members or beams 12 and 14 and two horizontal support members or bars 16 and 18. An upper region 20 and 22 of vertical beams 12 and 14, respectively, may be secured to a ceiling or other type of upper support, by ceiling brackets 24 and 26, respectively. A lower region 28 and 30 of vertical beams 12 and 14, respectively, may be secured to a floor or other type of ground support, by floor brackets 32 and 34, respectively.

Vertical support beams 12 and 14 may each include an elongate groove 36 and 38, respectively, that extends along an inner surface 40 and 42 of each of beams 12 and 14. A first end 44 and 46, respectively, of each of horizontal bars 16 and 18 may extend through a stabilizer plate 48 and 50, respectively, and into groove 36 of vertical beam 12. Similarly, a second end 52 and 54, respectively, of each of horizontal bars 16 and 18 may extend through a stabilizer plate 56 and 58, respectively, and into groove 38 of vertical beam 12. Clamp brake collars 60, 62, 64, and 66 may secure stabilizer plates 48, 50, 56 and 58, respectively, in place on vertical beams 12 and 14 so as to secure horizontal bars 16 and 18 in a stationary position. When clamp brake collars 60 and 64 are loosened by an artist utilizing easel 10, horizontal bar 16 may be moved upwardly in direction 68 or downwardly in direction 70. Similarly, when clamp brake collars 62 and 66 are loosened by an artist utilizing easel 10, horizontal bar 18 may be moved upwardly in direction 68 or downwardly in direction 70.

Horizontal support bars 16 and 18 may each include rail sleeves 72, 74, 76 and 78, respectively, slidably mounted thereon, wherein the rail sleeves will secure a work piece 80 (shown in dash lines) against movement rearwardly in direction 82, forwardly in direction 84, or laterally in either of directions 86 and/or 88. Accordingly, to secure work piece 80 on easel 10, lower horizontal bar 18 may be secured in place at a desired vertical height by use of clamp brakes 62 an 66. Rail sleeves 76 and 78 may then be moved along bar 18 to a desired position. A work piece 80 may then be placed with its lower edge 90 positioned on bar 18 and secured thereon by rail sleeves 76 and 78. Upper horizontal bar 16 may then be lowered on vertical beams 12 and 14, and rail sleeves 72 and 74 moved along horizontal bar 16 such that a top edge 92 of work piece 80 is secured by bar 16 and rail sleeves 72 and 74. Clamp brakes 60 and 64 may then be tightened in this position to securely fasten work piece 80 on easel 10 for work upon the work piece.

Movement of horizontal bars 16 and 18, while a work piece 80 may be secured thereon may be accomplished due to a plurality of pulley assemblies, discussed in detail below, which are positioned within an interior 94 and 96, respectively, of vertical support beams 12 and 14. Accordingly, by use of the pulley assemblies positioned within beams 12 and 14, an artist may initially position work piece 80, or may reposition work piece 80 during work thereon, easily and efficiently, without requiring the artist to bear the weight of the work piece during movement thereof. Moreover, due do the interior positioning of the pulley systems within vertical beams 12 and 14, and due to the use of ceiling brackets 24 and 26 and floor brackets 32 and 34, easel 10 has a depth 98 that is approximately the depth of vertical beams 12 and 14, the depth of work piece 80, and is generally much less than the overall depth of prior art easels. Easel 10, therefore, may be used directly against a wall in a small studio or back-to-back with a second easel in a crowded classroom. Moreover, because horizontal bars 16 and 18 may be moved completely along the length 100 and 102 of vertical beams 12 and 14, respectively, easel 10 may be used to support a work piece 80 that is essentially the same size as easel 10. Accordingly, easel 10 may be used for work on very large work pieces in an artist's studio that is not much larger than the large work piece itself.

Figure 2:
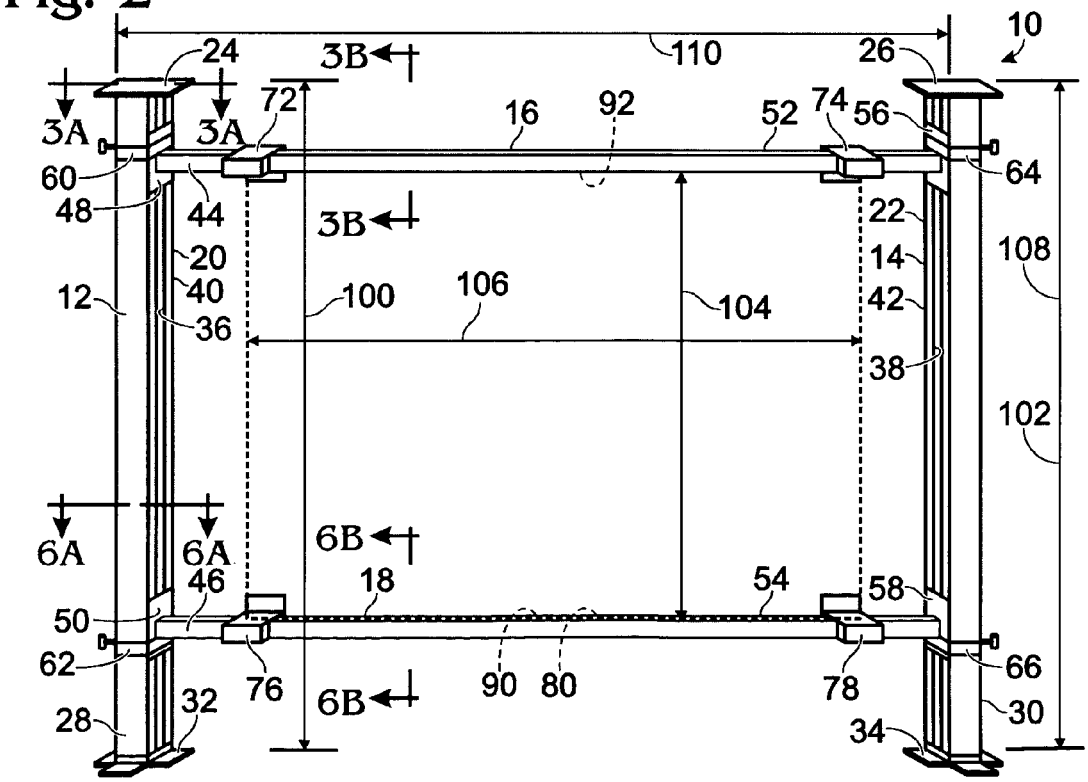
FIG. 2 is a front perspective view of one form of the artist's easel showing the horizontal support bars positioned for supporting a relatively large work piece.

FIG. 2 is a front perspective view of one form of the artist's easel 10 showing the horizontal support bars 16 and 18 positioned for supporting a relatively large work piece 80 (shown in dash lines) thereon. Accordingly, brake clamp collars 60, 62, 64, and 66 shown in FIG. 1 have been loosened, bars 16 and 18 have been moved from the position shown in FIG. 1, and the clamp brake collars have then been tightened in place to secured large work piece 80 on easel 10. As shown in FIG. 2, work piece 80 may have a height 104 and a width 106, that may be substantially similar to easel height 108 and easel width 110.

Figure 3B:
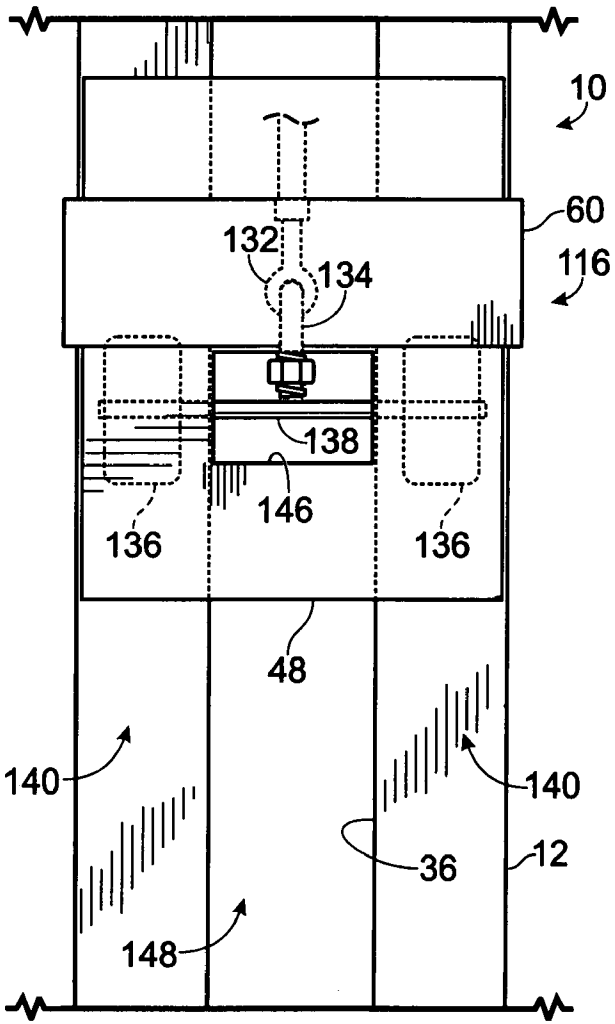
FIG. 3B is side view of one embodiment of the artist's easel looking in a direction 3B of FIG. 2 showing an upper pulley assembly.
Figure 3A:
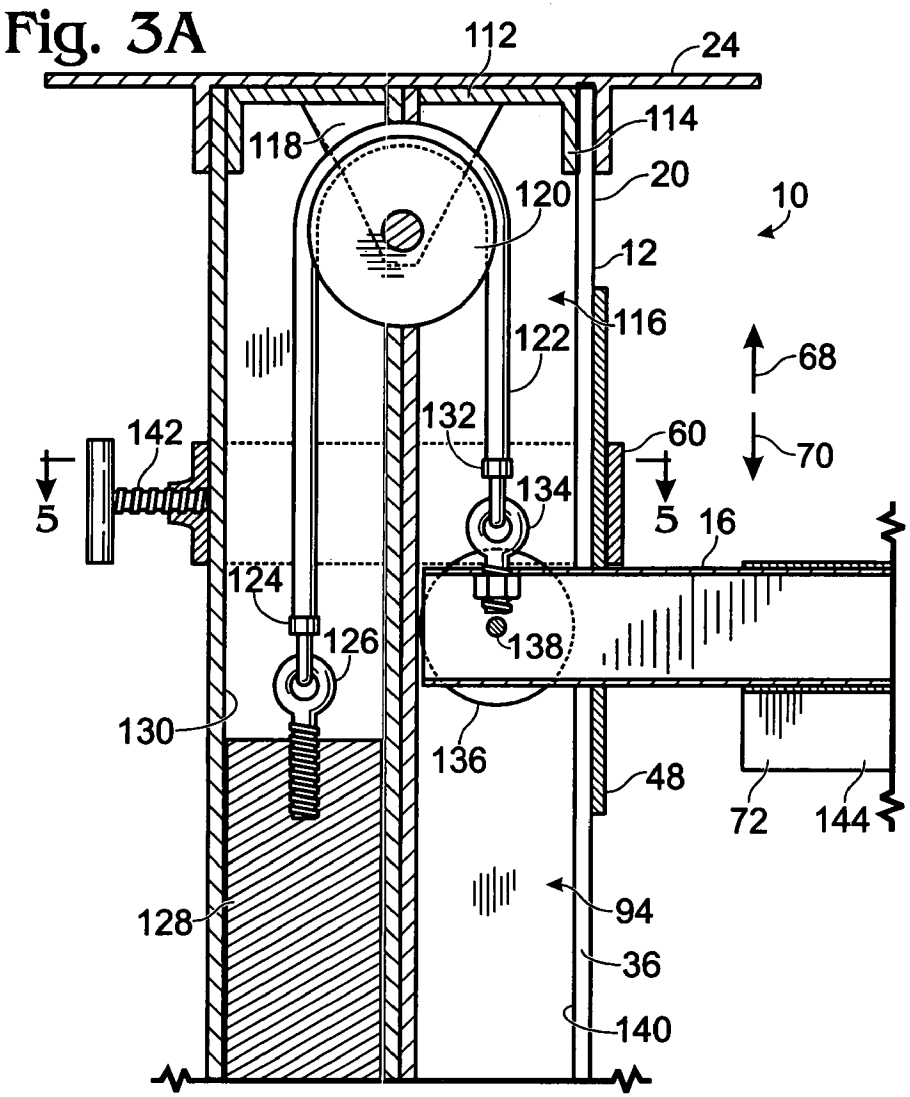
FIG. 3A is a cross-sectional side view of one embodiment of the artist's easel taken along line 3A-3A of FIG. 2 showing the upper horizontal support bar and the pulley assembly positioned within a vertical support beam.

FIG. 3A is a cross-sectional side view of one embodiment of artist's easel 10 taken along line 3A-3A of FIG. 2 showing upper region 20 of vertical support beam 12 secured within ceiling bracket 24 by a main pulley bracket 112 and an internal pulley bracket 114. A pulley assembly 116 may be positioned within vertical support beam 12 and may be secured to pulley brackets 112 and 114 by downwardly extending pulley roller supports 118, only one of which can be seen in this view. Pulley assembly 116 may include a pulley roller 120 and a pulley cable 122 extending over and around roller 120. A first end region 124 of pulley cable 122 may be secured to a lift ring 126 that may be secured within a lift weight 128 that moves along a weight track 130 of vertical beam 12. A second end region 132 of pulley cable 122 may be secured to a second lift ring 134 that may be secured to horizontal support bar 16 such that as horizontal bar 16 is moved in either of upwardly or downward directions 68 or 70, weight 128 will move in the opposite direction 70 or 68. Weight 128 may be sized so as to offset the weight of horizontal support bar 16 and/or a work piece 80 (see FIG. 1) supported thereon. To facilitate movement of horizontal bar 16 in directions 68 and 70 along groove 36 of vertical beam 12, two pulley wheels 136, only one of which may be seen in this view, may be secured to horizontal bar 16 by a pulley wheel axle 138 extending therethrough. Pulley wheels 136 may each be received within a pulley wheel track 140, only one of which can be seen in this view, and which is positioned within interior 94 of vertical beam 12.

Horizontal support bar 16 may extend into groove 36 of vertical beam 12 through stabilizer plate 48. Stabilizer plate 48, and therefore, horizontal bar 16, may be secured in a predetermined vertical position on vertical beam 12 by clamp brake collar 60 by use of a brake handle 142 which may be tightened within clamp brake collar 60. Upper rail sleeve 72, positioned on upper horizontal bar 16, may include a downwardly extending flange 144 that may prevent work piece 80 (see FIG. 1) from moving rearwardly when secured by rail sleeve 72.

FIG. 3B is side view of one embodiment of artist's easel 10 looking in a direction 3B of FIG. 2 showing upper pulley assembly 116. In this figure groove 36 of vertical beam 12 is clearly shown, as is aperture 146 in upper stabilizer plate 48 through which upper horizontal bar 16 (not shown in this figure for ease of illustration) extends. Pulley wheels 136 are also shown with pulley wheel axle 138 extending therethrough.

Figure 4:
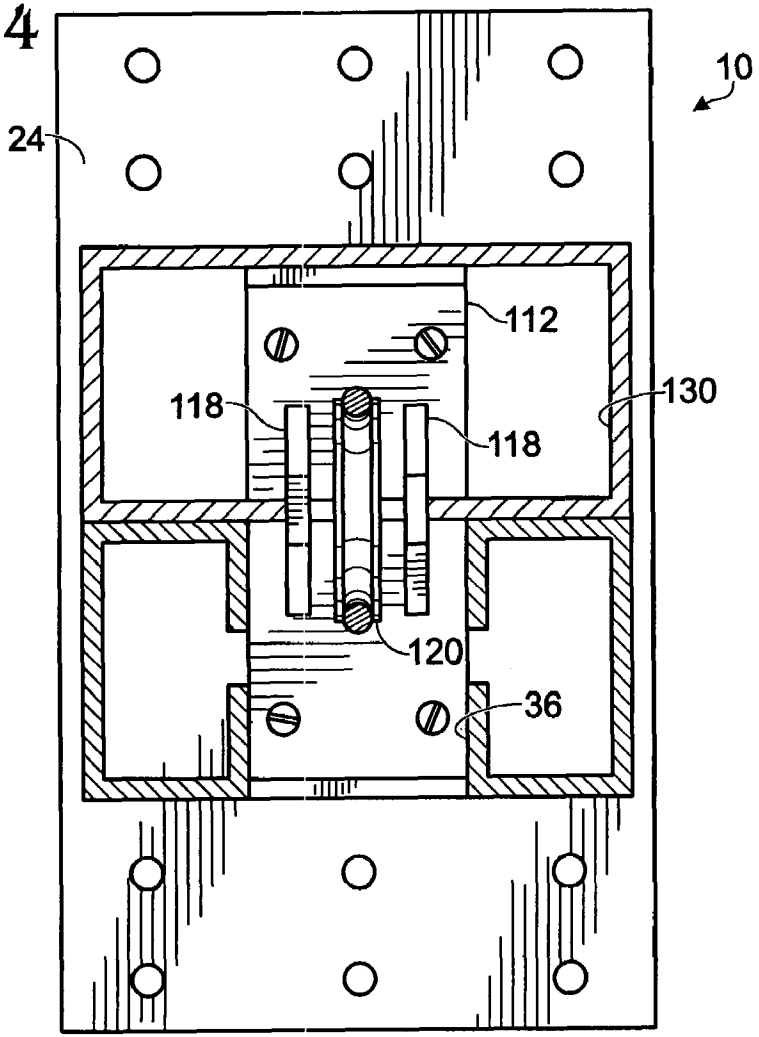
FIG. 4 is a cross-sectional view of one embodiment of the artist's easel taken along line 4-4 of FIG. 1 showing the pulley bracket and the ceiling bracket.

FIG. 4 is a cross-sectional view of one embodiment of artist's easel 10 taken along line 4-4 of FIG. 1 showing main pulley bracket 112 and ceiling bracket 24. Pulley roller 120 is shown positioned between pulley roller supports 118, and extending over both weight track 130 and groove 36.

Figure 5:
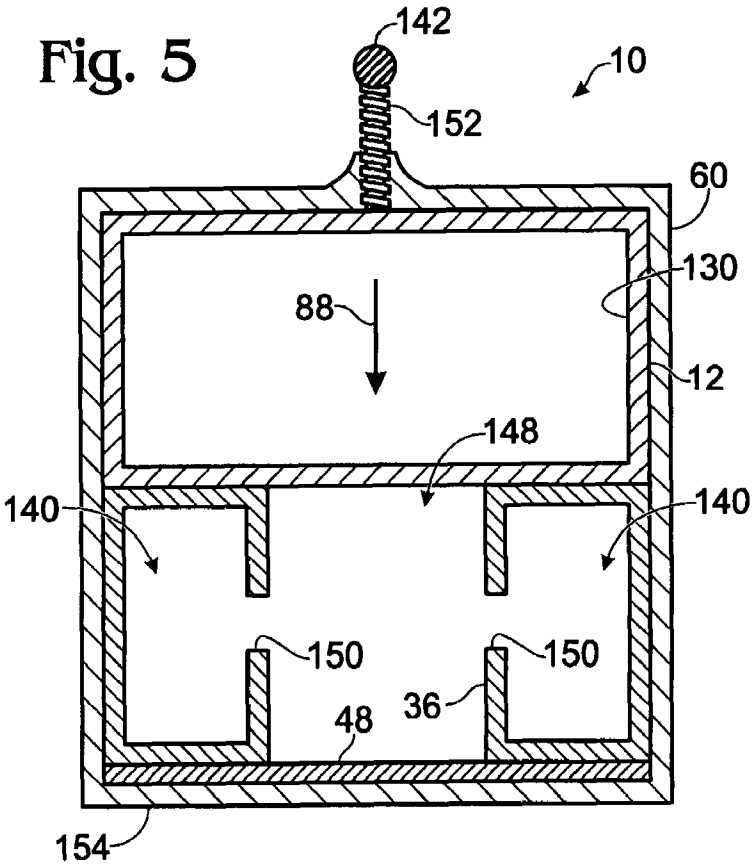
FIG. 5 is a cross-sectional view of one embodiment of the artist's easel taken along line 5-5 of FIG. 3A showing an upper clamp brake and the vertical support beam.

FIG. 5 is a cross-sectional view of one embodiment of artist's easel 10 taken along line 5-5 of FIG. 3A showing upper clamp brake collar 60 surrounding vertical support beam 12, which includes weight track 130, pulley wheel tracks 140 and groove 36 positioned therebetween. The space defined between pulley wheel tracks 140 and groove 36 may be referred to as a rail track 148. Each of pulley wheel tracks 140 include an elongate slit 150 which allows movement of pulley wheel axle 138 (see FIG. 3B) therealong. Stabilizer plate 48 is also shown secured within clamp brake collar 60. Tightening of clamp brake handle 142 may force a stem 152 of handle 142 in direction 88 toward weight track 130, thereby pushing weight track 130 and pulley wheel tracks 140 in direction 88 against stabilizer plate 48 and against a far wall 154 of clamp brake collar 60, thereby releasably securing stabilizer plate 48 in position on vertical beam 12.

Figure 6B:
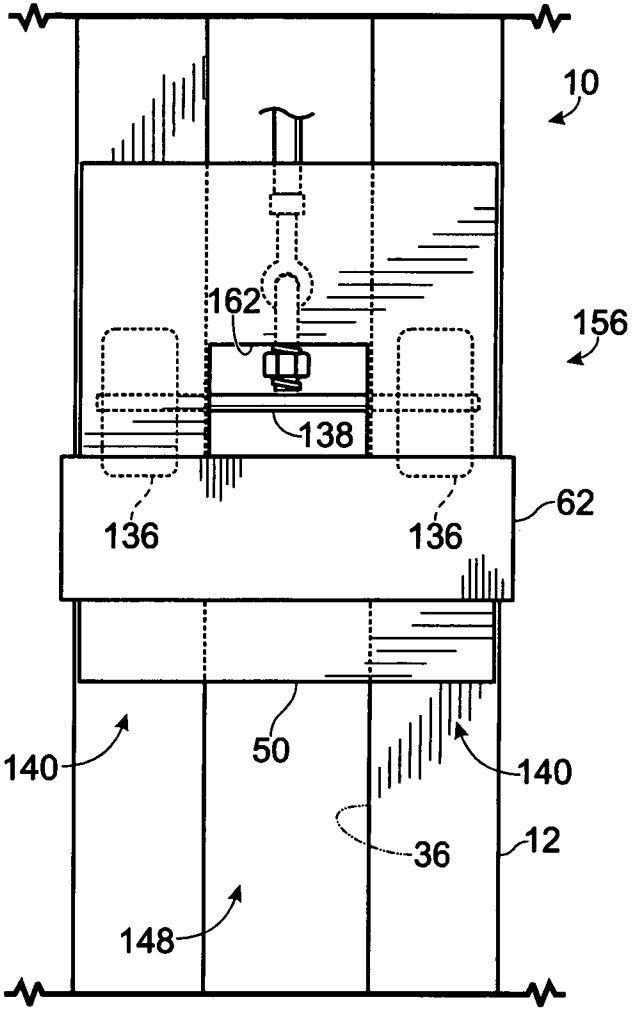
FIG. 6B is side view of one embodiment of the artist's easel looking in a direction 3B of FIG. 2 showing a lower pulley assembly.
Figure 6A:
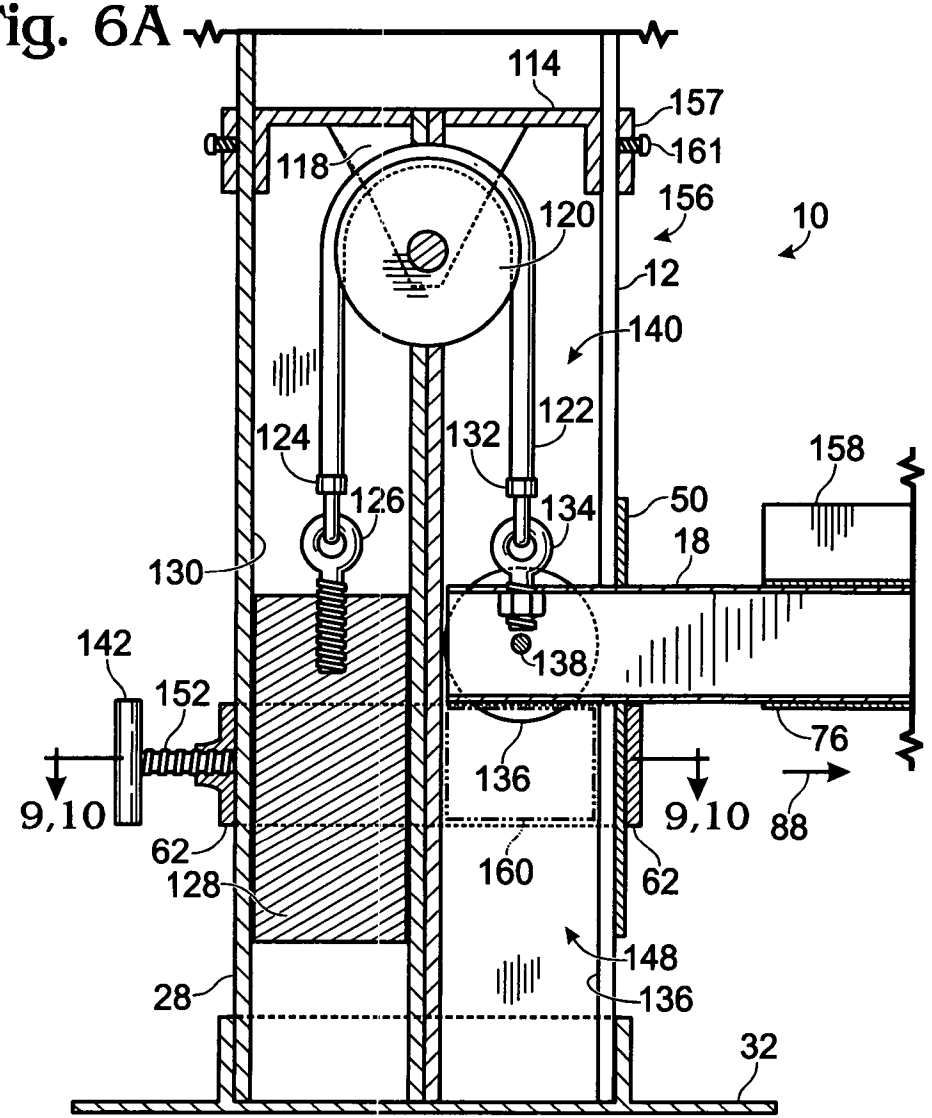
FIG. 6A is a cross-sectional side view of one embodiment of the artist's easel taken along line 6A-6A of FIG. 2 showing the lower horizontal support bar and a pulley assembly positioned within a vertical support beam.

FIG. 6A is a cross-sectional side view of one embodiment of artist's easel 10 taken along line 6A-6A of FIG. 2 showing lower horizontal support bar 18 and a lower pulley assembly 156 positioned within vertical support beam 12. Lower pulley assembly 156 generally is secured within vertical support beam 12 in a lower region 28 of vertical support beam 12, and more particularly, near or just below a midpoint of vertical support beam 12. In this manner, lower pulley assembly 156 may operate to move lower horizontal support bar 18 along vertical beam 12 in a lower half of beam 12. Lower pulley assembly 156 may comprise an internal pulley bracket 114 that includes pulley roller supports 118, only one of which can be seen in this view, and an external pulley bracket 157 and fasteners, such as set screws 160, to secure brackets 114 and 157 to vertical beam 12. Similar to upper pulley assembly 116 (see FIG. 3A), lower pulley assembly 156 may include a pulley roller 120, a pulley cable 122, a lift ring 126, a lift weight 128, a second lift ring 134, pulley wheels 136, and a pulley wheel axle 138 extending through wheels 136 and lower horizontal support bar 18. Support bar 18 may include rail sleeve 76 secured thereon, rail sleeve 76 including an upwardly extending flange 158 that may prevent work piece 80 (see FIG. 1) from moving rearwardly when secured by rail sleeve 76.

A brake block 160 may be secured to stabilizer plate 50 and may extend into rail track 148 through groove 36 in vertical support beam 12. Positioning of brake block 160 within lower clamp brake collar 62 may enhance the tightening capabilities of clamp brake collar 62 when brake handle 142 is tightened around vertical support beam 12. In particular, brake block 160 may fill the space defined by rail track 148 such that when brake handle 142 is tightened to secure collar 62 around vertical beam 12, weight track 130 is pushed in direction 88 against wheel tracks 140 and brake block 160 such that weight track 130 and brake block 160 may contact lower stabilizer plate 50.

FIG. 6B is side view of one embodiment of artist's easel 10 looking in a direction 3B of FIG. 2 showing lower pulley assembly 156. In this figure groove 36 of vertical beam 12 is clearly shown, as is aperture 162 in lower stabilizer plate 50 through which lower horizontal bar 18 (not shown in this figure for ease of illustration) extends. Pulley wheels 136 are also shown with pulley wheel axle 138 extending therethrough.

In another embodiment, aperture 162 may be larger than shown and brake block 160 may be secured directly to clamp brake collar 62 and extend into rail track 148 through aperture 162.

Figure 7:
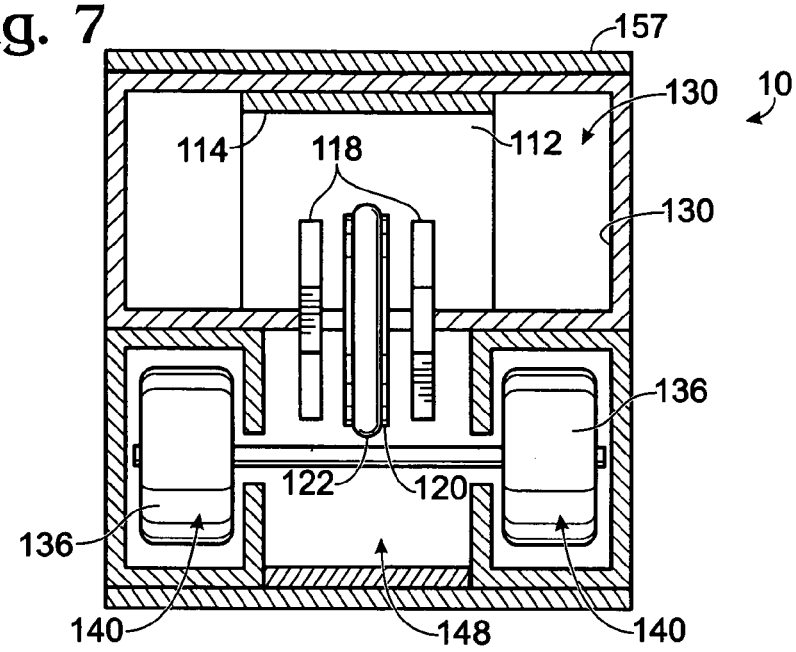
FIG. 7 is a cross-sectional view of one embodiment of the artist's easel taken along line 7-7 of FIG. 1 showing the pulley bracket.

FIG. 7 is a cross-sectional view of one embodiment of artist's easel 10 taken along line 7-7 of FIG. 1 showing external pulley bracket 157, internal pulley bracket 114 and main pulley bracket 112. Pulley roller 120 is shown positioned between pulley roller supports 118, and extending over both weight track 130 and rail track 148.

Figure 8:
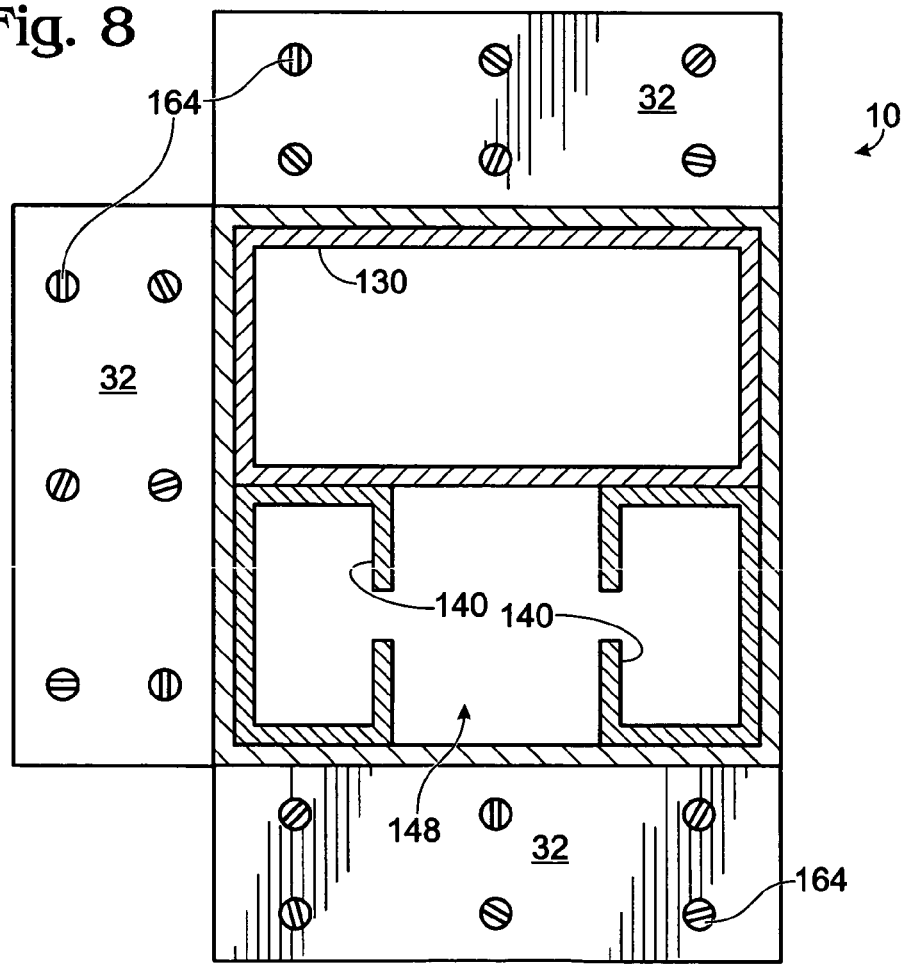
FIG. 8 is a cross-sectional view of one embodiment of the artist's easel taken along line 8-8 of FIG. 1 showing the floor bracket.

FIG. 8 is a cross-sectional view of one embodiment of artist's easel 10 taken along line 8-8 of FIG. 1 showing floor bracket 32 secured to a ground surface by fasteners such as screws 164. Floor bracket 32 may extend upwardly approximately one or two inches and may secure therein weight track 130 and pulley wheel tracks 140.

Figure 9:
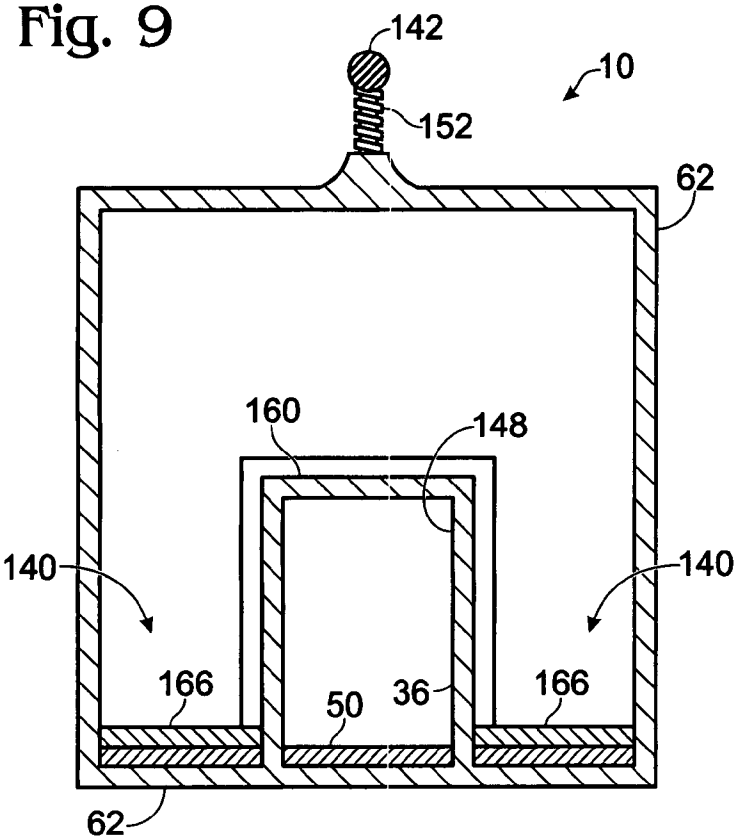
FIG. 9 is a cross-sectional view of one embodiment of the artist's easel taken along line 9-9 of FIG. 6A showing a lower clamp brake without other internal components.

FIG. 9 is a cross-sectional view of one embodiment of artist's easel 10 taken along line 9-9 of FIG. 6A showing lower clamp brake 62 without selected internal components. In particular, this figure shows clamp brake collar 62 positioned against a side wall 166 of pulley wheel track 140 and lower stabilizer plate 50. Brake block 160 is shown secured to lower stabilizer plate 50 and extending into rail track 148 and positioned below lower horizontal support bar 18.

Figure 10:
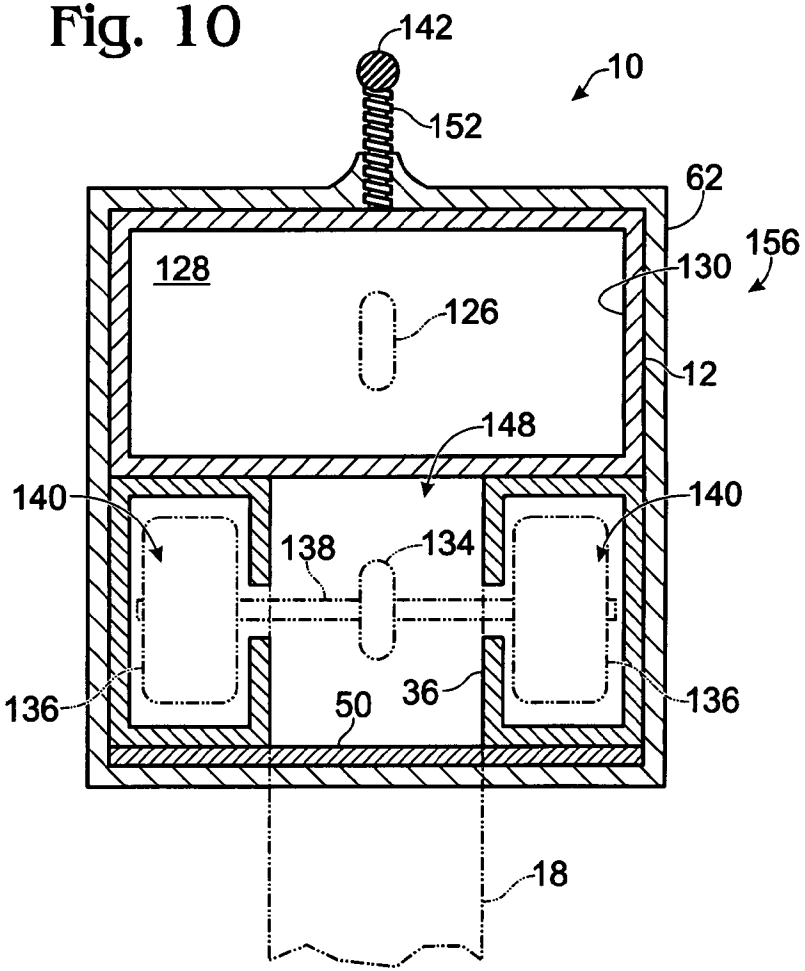
FIG. 10 is a cross-sectional view of one embodiment of the artist's easel taken along line 10-10 of FIG. 6A showing the lower clamp brake, the pulley assembly and the vertical support beam.

FIG. 10 is a cross-sectional view of one embodiment of artist's easel 10 taken along line 10-10 of FIG. 6A showing lower clamp brake collar 62 surrounding vertical support beam 12 including weight track 130, pulley wheel tracks 140, rail track 148 and lower stabilizer plate 50. Lower pulley assembly 156 is shown including weight 128 secured to lift ring 126 and second lift ring 134 secured to lower horizontal support bar 18. Wheel axle 138 is shown extending through support bar 18 and pulley wheels 136.

Figure 11:
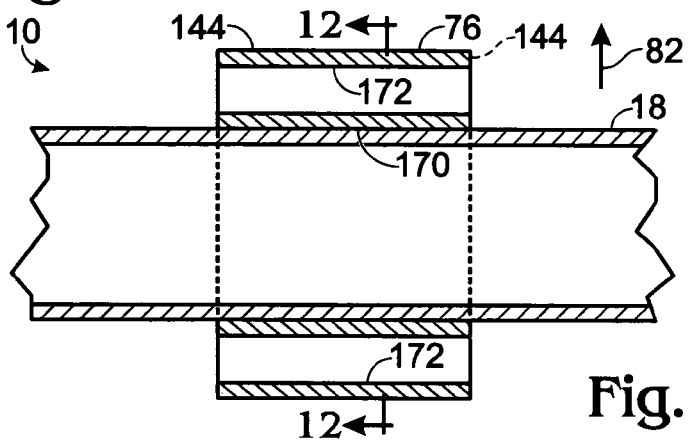
FIG. 11 is a cross-sectional view of one embodiment of the artist's easel taken along line 11-11 of FIG. 1 showing a rail sleeve.

FIG. 11 is a cross-sectional view of one embodiment of artist's easel 10 taken along line 11-11 of FIG. 1 showing rail sleeve 76. Sleeve 76 may include an aperture 170 extending therethrough which surrounds horizontal support bar 18 and slidably secures rail 76 thereon. Sleeve 76 may further include two insert apertures 172 for receiving a rail sleeve insert (see FIG. 13) therein. Sleeve 170 may also include flange 144 extending upwardly from horizontal support bar 18 to secure work piece 80 (see FIG. 1) from rearward movement in direction 82 on easel 10. Flange 144 may extend upwardly from rail 18 approximately one inch or any other such distance as may be suitable for a particular artist's application.

Figure 12:
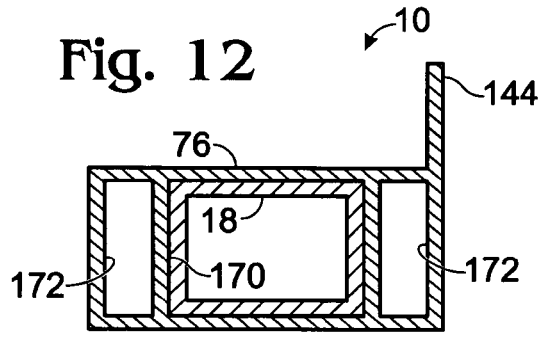
FIG. 12 is a cross-sectional view of one embodiment of the artist's easel taken along line 12-12 of FIG. 11 showing the rail sleeve positioned on a horizontal support bar.

FIG. 12 is a cross-sectional view of one embodiment of artist's easel 10 taken along line 12-12 of FIG. 11 showing rail sleeve 76 positioned on horizontal support bar 18.

Figure 13:
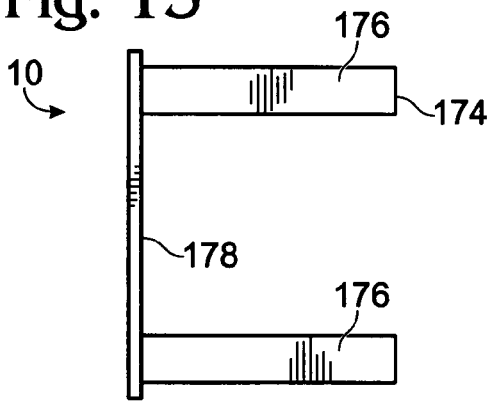
FIG. 13 is a top view of a rail sleeve insert.

FIG. 13 is a top view of a rail sleeve insert 174 including two insert legs 176 and a support flange 178.

Figure 14:
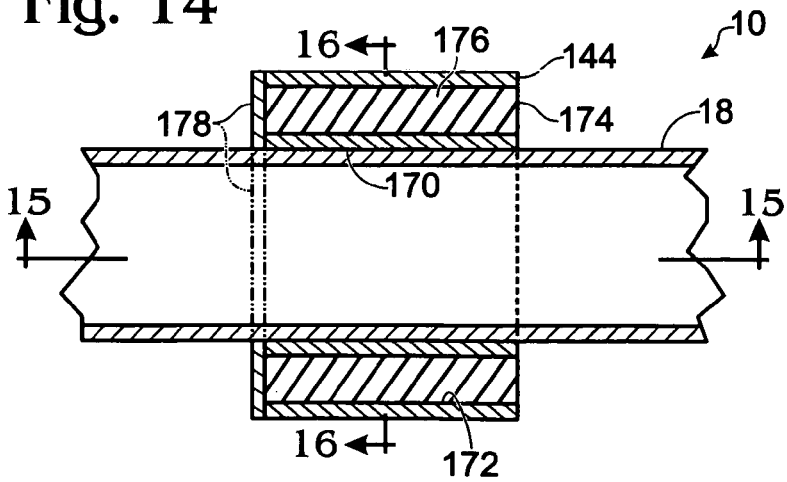
FIG. 14 is a cross-sectional view of one embodiment of the artist's easel similar to the view shown in FIG. 11 and including the rail sleeve insert positioned within the rail sleeve.

FIG. 14 is a cross-sectional view of one embodiment of artist's easel 10 similar to the view shown in FIG. 11 and including rail sleeve insert 174 positioned within rail sleeve 76. In particular, rail sleeve insert legs 176 of insert 174 are positioned and frictionally secured within insert apertures 172 of rail sleeve 76. In another embodiment, insert legs 176 may be secured within rail sleeve 76 by fasteners such as set screws or the like.

Figure 15:
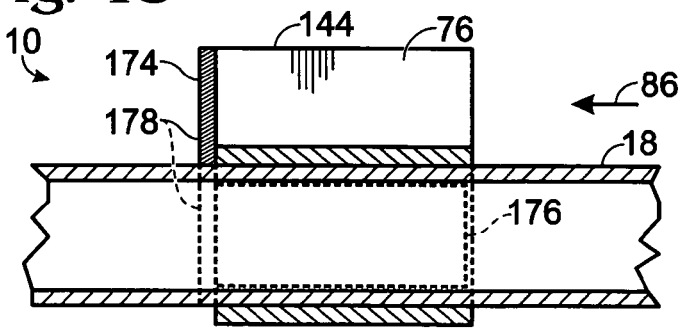
FIG. 15 is a cross-sectional view of one embodiment of the artist's easel taken along line 15-15 of FIG. 14 showing the rail sleeve and the rail sleeve insert positioned on a horizontal support bar.

FIG. 15 is a cross-sectional view of one embodiment of artist's easel 10 taken along line 15-15 of FIG. 14 showing rail sleeve 76 and rail sleeve insert 174 positioned on lower horizontal support bar 18. Flange 178 may secure work piece 80 (see FIG. 1) from lateral movement in direction 86 on easel 10.

Figure 16:
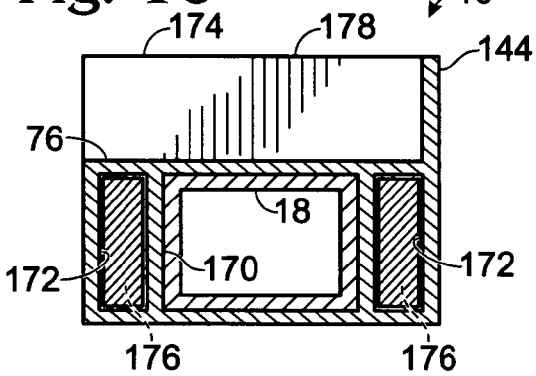
FIG. 16 is a cross-sectional view of one embodiment of the artist's easel taken along line 16-16 of FIG. 14 showing the rail sleeve and the rail sleeve insert positioned on a horizontal support bar.

FIG. 16 is a cross-sectional view of one embodiment of artist's easel 10 taken along line 16-16 of FIG. 14 showing rail sleeve 76 and rail sleeve insert 174 positioned on lower horizontal support bar 18.

Figure 17:
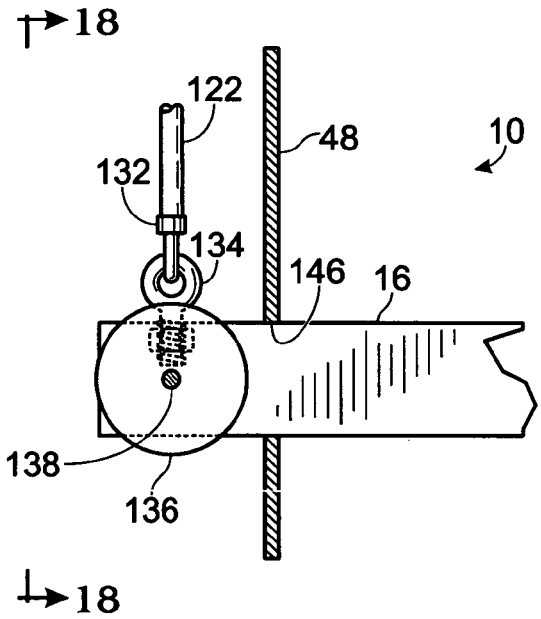
FIG. 17 is a front view of one embodiment of the artist's easel showing the upper pulley wheel, upper horizontal support bar and upper stabilizer plate.

FIG. 17 is a front view of one embodiment of artist's easel 10 showing upper lift ring 134, upper pulley wheels 136, upper stabilizer plate 48, and upper horizontal support bar 16 extending through aperture 146 in stabilizer plate 48. Wheel axle 138 is shown extending through wheels 136 and horizontal support bar 16 such that movement of lift ring 134 will lift bar 16, wheels 136 and stabilizer plate 48 as one integral unit.

Figure 18:
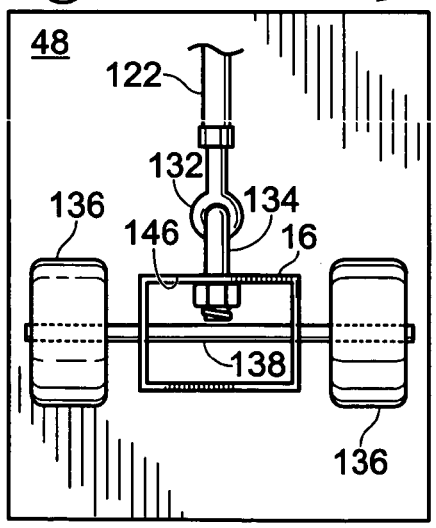
FIG. 18 is a side view of one embodiment of the artist's easel showing the upper pulley wheel, upper horizontal support bar and upper stabilizer plate.

FIG. 18 is a side view of one embodiment of artist's easel 10 showing upper lift ring 134, upper pulley wheels 136, wheel axle 138, and upper stabilizer plate 48 having aperture 146 therein.

Figure 19:
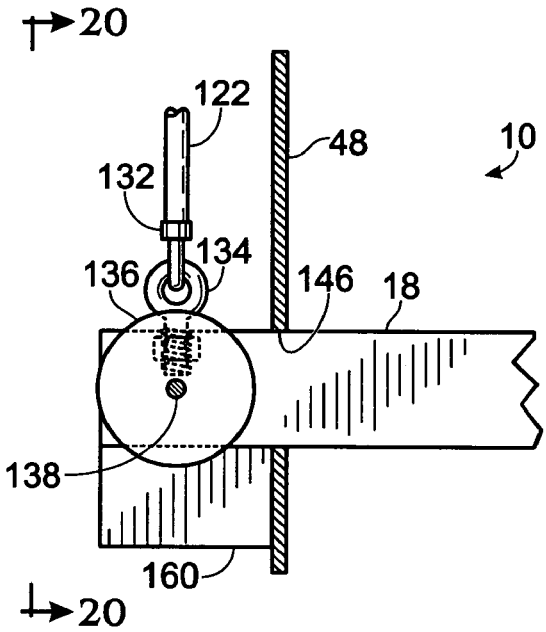
FIG. 19 is a front view of one embodiment of the artist's easel showing the lower pulley wheel, lower horizontal support bar and lower stabilizer plate.

FIG. 19 is a front view of one embodiment of artist's easel 10 showing lower lift ring 134, lower pulley wheels 136, lower stabilizer plate 50, brake block 160 secured to lower stabilizer plate 50, and lower horizontal support bar 18 extending through aperture 146 in stabilizer plate 50. Wheel axle 138 is shown extending through wheels 136 and horizontal support bar 18 such that movement of lift ring 134 will lift bar 18, wheels 136 and stabilizer plate 50 as one integral unit.

Figure 20:
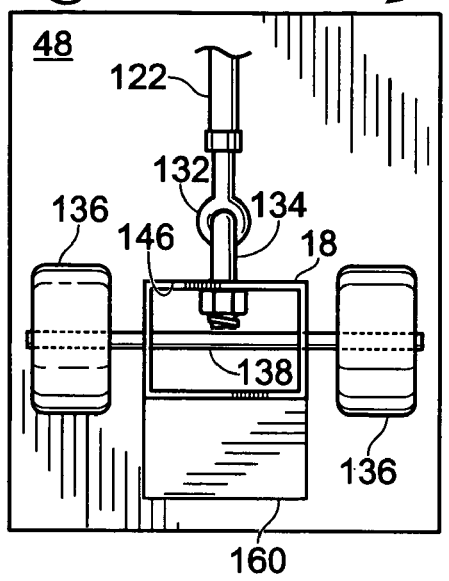
FIG. 20 is a side view of one embodiment of the artist's easel showing the lower pulley wheel, lower horizontal support bar and lower stabilizer plate.

FIG. 20 is a side view of one embodiment of artist's easel 10 showing lower lift ring 134, lower pulley wheels 136, wheel axle 138, and upper stabilizer plate 50 having aperture 146 therein and brake block 160 secured thereto.

Pulley wheels 136 may be manufactured of rubber, plastic, metal or the like. Pulley cable 122 may be manufactured of steel cable, rope or any other durable and strong material. Vertical support beams 12 and 14, horizontal support bars 16 and 18, ceiling brackets 24 and 26, floor brackets 32 and 34, rail sleeves 72, 74, 76 and 78, rail sleeve inserts 174, brake clamp collars 60, 62, 64 and 66, stabilizer plates 48, 50, 56 and 58, weights 128, and any other structural components may be manufactured of steel or other such strong and durable material as may be desired. Supports 12, 14, 16 and 18 may be manufactured by the process of extrusion and cut to any desired length such that easel 10 may have any height or width dimensions as may be suitable for a particular application.

Other enhancements may be made to the easel wherein such variations and modifications of the concepts described herein fall within the scope of the claims below.

I claim:

1. An easel, comprising:

a first hollow vertical support member including a first hollow interior and a first pulley assembly positioned completely within said first hollow interior;

a second hollow vertical support member including a second hollow interior and a second pulley assembly positioned completely within said second hollow interior;

a first horizontal support member secured directly to and extending between said first vertical support member and said second vertical support member and adapted to secure a first edge of an artist work piece thereto; and a second horizontal support member secured directly to and extending between said first vertical support member and said second vertical support member and adapted to secure a second edge of an artist work piece thereto, wherein said first horizontal support member is moved vertically on said first hollow vertical support member by said first pulley assembly and said second horizontal support member is moved vertically on said second hollow vertical support member by said second pulley assembly, further comprising a third pulley assembly positioned within said first hollow interior and said first horizontal support member and a fourth pulley assembly positioned within said second hollow interior and said second horizontal support member, wherein said second horizontal support member is moved vertically on said first vertical support member by said third pulley assembly and is moved vertically on said second vertical support member by said fourth pulley assembly.

2. An easel according to claim 1 wherein said first pulley assembly is positioned in a top region of said first vertical support member, said second pulley assembly is positioned in a top region of said second vertical support member, said third pulley assembly is positioned in a central region of said first vertical support member, and said fourth pulley assembly is positioned in a central region of said second vertical support member.

3. An easel, comprising:

a first hollow vertical support member including a first hollow interior and a first pulley assembly positioned completely within said first hollow interior;

a second hollow vertical support member including a second hollow interior and a second pulley assembly positioned completely within said second hollow interior;

a first horizontal support member secured directly to and extending between said first vertical support member and said second vertical support member and adapted to secure a first edge of an artist work piece thereto; and a second horizontal support member secured directly to and extending between said first vertical support member and said second vertical support member and adapted to secure a second edge of an artist work piece thereto, wherein said first horizontal support member is moved vertically on said first hollow vertical support member by said first pulley assembly and said second horizontal support member is moved vertically on said second hollow vertical support member by said second pulley assembly, further comprising a rail sleeve slidably mounted on said first horizontal support member, said rail sleeve securing a first edge of an artist work piece from rearward movement relative to said first horizontal support member.

4. An easel according to claim 3 further comprising a rail sleeve insert secured on said rail sleeve, said rail sleeve insert securing said first edge of said artist work piece from lateral movement along said first horizontal support member.

5. An easel for supporting an artist work piece, comprising:

a vertical support member including an interior cavity;

a pulley system positioned completely within said interior cavity, said pulley system adapted for moving a horizontal support member on said vertical support member;

a horizontal support member secured to said pulley system and extending into said interior cavity of said vertical support member, said horizontal support member including an upper surface that defines a continuous flat expanse structured to support an artist work piece;

a clamp that releasably secures said horizontal support member on said vertical support member; and a rail sleeve slidably mounted on said horizontal support member, said rail sleeve including an upwardly extending surface structured to prevent a work piece from moving rearwardly off said horizontal support member.

6. An easel according to claim 5 further comprising a brake block secured to said clamp and positioned within said vertical support member interior cavity.

7. An easel according to claim 5 wherein said horizontal support member is structured to immovably support an artist work piece when said horizontal support member is secured on said vertical support member by said clamp.

8. An easel according to claim 5 wherein said upper surface of said horizontal support member defines said continuous flat expanse along an entire length of said upper surface of said horizontal support member.

9. An artist's easel, comprising:

a pair of vertical supports, each support including a cross section having a weight track and a horizontal support track;

a pair of horizontal supports each including a first end extending into said horizontal support track of one of said pair of vertical supports and each including a second end extending into said horizontal support track of the other of said pair of vertical supports;

first and second pulley assemblies positioned within both an interior cavity of one of said pair of vertical supports and one of said pair of said horizontal supports; and third and fourth pulley assemblies positioned within both an interior cavity of the other of said pair of vertical supports and the other of said pair of said horizontal supports, wherein one of said horizontal supports is secured to said first and third pulley assemblies for movement along said vertical supports, and wherein the other of said horizontal supports is secured to said second and fourth pulley assemblies for movement along said vertical supports.

10. An easel according to claim 9 wherein said pair of vertical supports each define a depth, said easel defines a depth, and wherein said depth of said vertical supports is the same as the depth of said easel.

11. An easel for supporting an artist work piece, comprising:

a vertical support member including an interior cavity;

a pulley system positioned completely within said interior cavity, said pulley system adapted for moving a horizontal support member on said vertical support member;

a horizontal support member secured to said pulley system and extending into said interior cavity of said vertical support member, said horizontal support member structured to support a lower surface of an artist work piece;

a rail sleeve slidably mounted on said horizontal support member, said rail sleeve including an upwardly extending stop surface; and a clamp that releasably secures said horizontal support member on said vertical support member.

12. An easel according to claim 11 wherein said horizontal support member includes an upper surface that defines a planar surface along an entire length of said upper surface of said horizontal support member.

* * * * *